US008866057B2

(12) United States Patent
Geswender

(10) Patent No.: US 8,866,057 B2
(45) Date of Patent: Oct. 21, 2014

(54) FIN DEPLOYMENT METHOD AND APPARATUS

(75) Inventor: Chris E. Geswender, Green Valley, AZ (US)

(73) Assignee: Raytheon Company, Waltham, MA (US)

( * ) Notice: Subject to any disclaimer, the term of this patent is extended or adjusted under 35 U.S.C. 154(b) by 406 days.

(21) Appl. No.: 13/274,426

(22) Filed: Oct. 17, 2011

(65) Prior Publication Data

US 2013/0092790 A1 Apr. 18, 2013

(51) Int. Cl.

| | |
|---|---|
| ***F42B 15/01*** | (2006.01) |
| ***F42B 10/14*** | (2006.01) |
| ***F42B 10/20*** | (2006.01) |
| ***F41A 21/32*** | (2006.01) |
| *F41A 21/46* | (2006.01) |

(52) U.S. Cl.

CPC ..... *F42B 10/14* (2013.01); *F41A 21/46* (2013.01); *F41A 21/32* (2013.01)

USPC ..... 244/3.27; 244/3.28; 244/3.29

(58) Field of Classification Search

USPC ..... 244/63, 3.27, 3.28, 3.29; 89/1.81, 1.816

See application file for complete search history.

(56) References Cited

U.S. PATENT DOCUMENTS

| | | | | |
|---|---|---|---|---|
| 4,332,360 | A * | 6/1982 | Topliffe | 244/3.27 |
| 5,082,203 | A * | 1/1992 | Baubry | 244/3.28 |
| 6,224,013 | B1 * | 5/2001 | Chisolm | 244/3.27 |
| 6,450,444 | B1 * | 9/2002 | Sorvino | 244/3.24 |
| 6,796,525 | B2 * | 9/2004 | Johnsson et al. | 244/3.27 |
| 6,997,770 | B2 * | 2/2006 | Lapointe | 124/66 |
| 7,083,140 | B1 * | 8/2006 | Dooley | 244/3.27 |
| 8,253,085 | B1 * | 8/2012 | Lichtenberg-Scanlan et al. | 244/3.27 |
| 2007/0084961 | A1 * | 4/2007 | Johnsson et al. | 244/3.28 |
| 2011/0186678 | A1 * | 8/2011 | Sankovic | 244/3.27 |

* cited by examiner

*Primary Examiner* — Rob Swiatek
*Assistant Examiner* — Marc Burgess
(74) *Attorney, Agent, or Firm* — Renner, Otto, Boisselle & Sklar, LLP

(57) ABSTRACT

An air vehicle that is launched from inside a launcher, includes a release mechanism for releasing fins of the vehicle from a stowed condition to a deployed condition. The release mechanism includes a pin that is located within a cavity in the fuselage of the air vehicle. Pressurized gasses initially fill the cavity in the fuselage. The launcher includes a reduced-pressure portion such as from a muzzle brake. When the air vehicle passes into the reduced-pressure portion of the launcher, the gas pressure behind the air vehicle is reduced. This causes the pressurized gas within the cavity to drive the release mechanism backwards out of the cavity. The length of the pin may be used to control the timing of the fin deployment, the delay between the initial movement of the release mechanism out of the cavity, and when the fins are released.

19 Claims, 5 Drawing Sheets

FIN DEPLOYMENT METHOD AND APPARATUS

BACKGROUND OF THE INVENTION

1. Field of the Invention

The invention is in the field of air vehicles launched from launchers, such as powered or unpowered projectiles launched from gun tubes, launch tubes, or other launchers, with end features that could interfere with deployed surfaces of the air vehicles.

2. Description of the Related Art

Air vehicles launched from launch tubes, gun tubes, or other launchers often have fins that are used in flight to stabilize the vehicle, as well as for other purposes. The fins are stowed during launch, in order to allow the air vehicle to fit in the launcher.

Pressurized gases produced for propulsion during launch may get underneath the fins during the launch process. Near the mouth of the launcher there may be a muzzle brake or other openings which redirect pressure that is inside the launcher, for instance to reduce recoil. The pressurized gasses trapped underneath the fins may tend to push the fins outward, which is undesirable, as contact between the fins and the walls of the launcher may damage the fins and/or the launcher, and/or may adversely affect trajectory of the air vehicle.

If the launcher is rifled, so that the air vehicle spins about its longitudinal axis as part of the launch process, centrifugal forces may urge the fins outward prior to the vehicle exiting the launcher. Again premature deployment of fins would be undesirable.

In view of the above, it would be desirable to easily control fin deployment. Management of fin deployment may be accomplished by control of roll rate, internal pressurization, and fin moments of inertia, but such control puts restraint on performance.

SUMMARY OF THE INVENTION

A launcher-fired air vehicle has a release mechanism for releasing fins from a stowed configuration. The release mechanism is ejected from a cavity in the fuselage when the vehicle reaches a low-pressure region of the launcher where a muzzle brake is located. The release mechanism includes a pin with a length selected so that it releases the fins after a delay, preventing the fins from beginning deployment while still in the launcher in such a way that would cause the fins to contact the wall or walls of the launcher.

According to an aspect of an invention, an air vehicle launched from a launcher includes: a fuselage; fins coupled to the fuselage, wherein the fins deploy from an initial stowed configuration in the launcher to a deployed configuration in flight; a release mechanism that releases the fins from the stowed configuration, wherein the release mechanism includes a longitudinally oriented pin in a cavity in the fuselage; and a valve that selectively lets pressurized gasses into the cavity through the valve.

According to a further aspect of the invention, a method of launching an air vehicle from a launcher includes: using pressurized gasses to move the air vehicle within the launcher; when an aft end of the air vehicle reaches openings near the muzzle of the launcher, beginning movement of a release mechanism for releasing the fins of the air vehicle; and after a delay following the beginning movement of the release mechanism, using movement of the release mechanism to release a restraint that keeps fins of the air vehicle from deploying.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

An air vehicle that is launched from inside a launcher, includes a release mechanism for releasing fins of the vehicle from a stowed condition to a deployed condition. The release mechanism includes a pin that is located within a cavity in the fuselage of the air vehicle. Pressurized gasses are used within the launcher to provide a force to accelerate the air vehicle and expel it from the launcher. The same pressurized gasses initially fill the cavity in the fuselage. The launcher includes a reduced-pressure portion, wherein the internal gas pressure behind the air vehicle, within the launcher, is reduced by openings, such as from a muzzle brake. When the air vehicle passes into the reduced-pressure portion of the launcher, the gas pressure behind the air vehicle is reduced. This causes the pressurized gas within the cavity to drive the release mechanism backwards relative to the air vehicle, out of the cavity. Once the release mechanism has moved back far enough, the pin clears the vehicle, and the fins are released to begin deployment from the stowed condition. The length of the pin may be used to control the timing of the fin deployment, the delay between the initial movement of the release mechanism out of the cavity, and when the fins are released. The mechanism provides a simple, inexpensive, and reliable way to control timing of fin deployment, to prevent fins from deploying early and contacting the side(s) of the launcher, for example.

Figure 1:
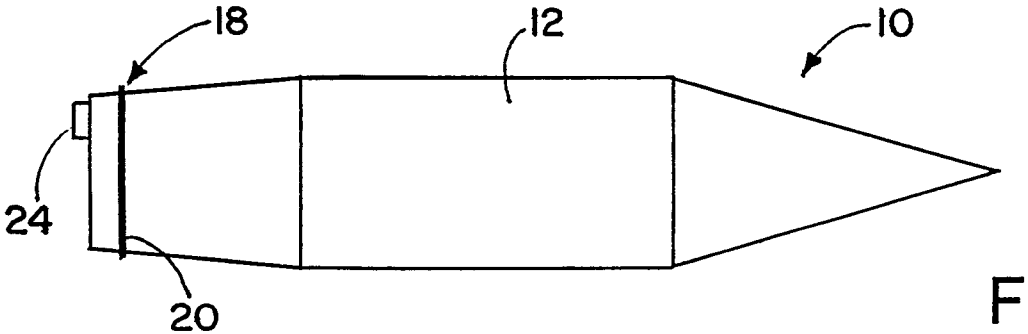
FIG. 1 is a side view of an air vehicle in accordance with an embodiment of the present invention.
Figure 2:
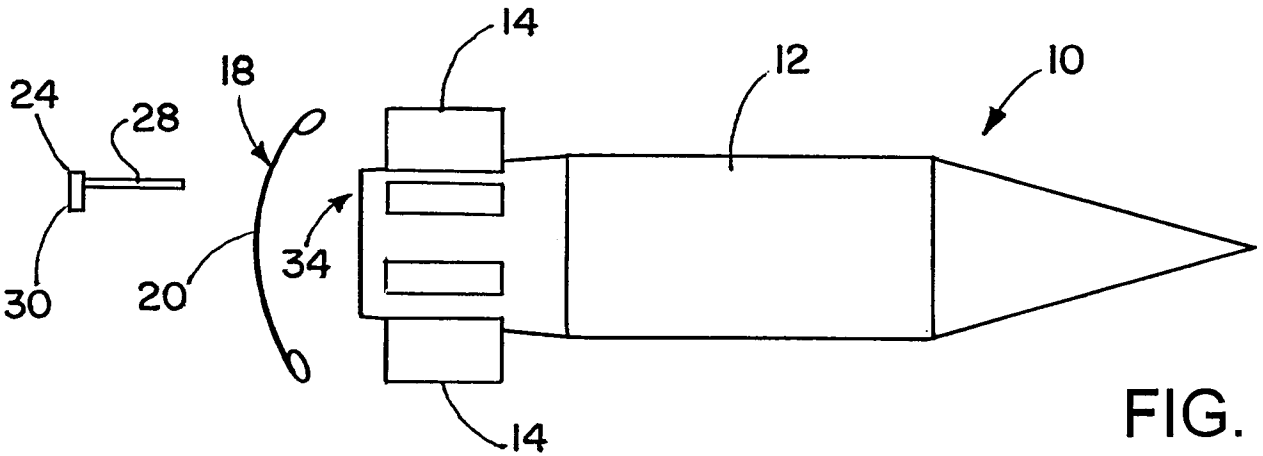
FIG. 2 is a side view of the air vehicle of FIG. 1, with its restraint removed and its fins deployed.

FIGS. 1 and 2 show an air vehicle 10 that includes a fuselage 12. Fins 14 are deployable from the fuselage 12, with FIG. 1 showing the fins 14 in a stowed condition or state, such as around or within the fuselage 12, and FIG. 2 showing the fins 14 in a deployed state or condition, external to the fuselage 12. The fins 14 may deploy from slots within the fuselage 12, from being wrapped around the fuselage 12, from being folded or rotated against or into the fuselage 12, or in any of a variety of other suitable configurations.

The fins 14 are mechanically restrained by a restraint 18 in order to keep the fins 14 in the stowed condition during launch of the air vehicle 10 from a launcher, such as a launch tube. The restraint 18 may include a band or cable 20 that is wrapped around the fuselage 12.

Figure 3:
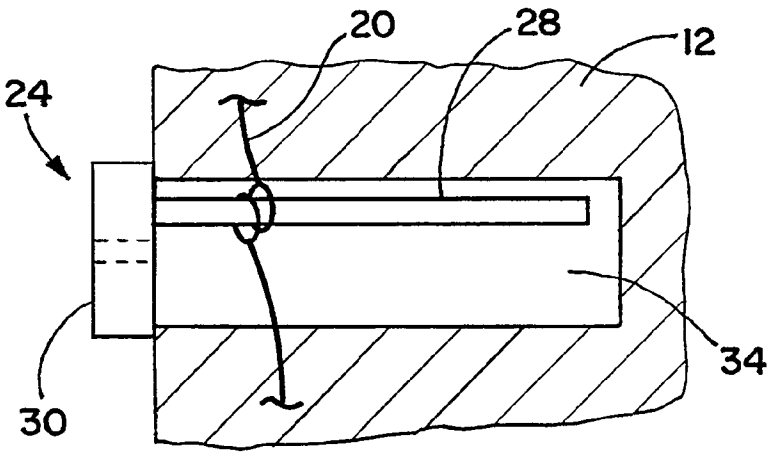
FIG. 3 is a detailed cross-sectional view of part of one embodiment of the air vehicle of FIG. 1.

With reference now in addition to FIG. 3, the restraint 18 is held in place by a release mechanism 24. The release mechanism 24 includes a pin 28 that emerges from a base 30. The term "pin" is used herein to broadly indicate a protrusion that extends forward from the base 30. The pin 28 may have any of a variety of shapes, sizes, or configurations. The pin 28 is in a cavity 34 in the aft end of the fuselage 12. The pin 28 maintains the restraint 18 in place while the pin 28 is in the cavity 34. As one example, the pin 28 may pass through loops at the ends of the band or cable 20, holding the ends of the band or cable 20 together. When the pin 28 is pulled out of the loops, the band or cable 20 releases, falling away from the air vehicle 10, and letting the fins 14 deploy.

As described in greater detail below, the release mechanism 24 is detached from the fuselage 12 by pressure forces. As pressurized gasses build up in the launcher behind the air vehicle 10, the pressurized gasses also enter the cavity 34. Eventually the aft end of the air vehicle 10 reaches a low-pressure region at the end of the launcher, a region where a muzzle brake is located or where there are other openings in the barrel of the launcher. When the aft end of the air vehicle 10 passes into this low-pressure region, there is an imbalance of pressure forces on the base 30 of the release mechanism 24, since the pressure from the high-pressure gasses still inside the cavity 34 are greater than the pressure pushing from the outside of the base 30. This imbalance of pressure forces pushes the release mechanism longitudinally back relative to the fuselage 12, causing the release mechanism 24 to be expelled from the cavity 34.

The pin 28 may be made long enough in a longitudinal direction to delay the release of the restraint 18 for some time after the movement of the release mechanism 24 begins. The length of the pin 28 may be chosen such that the restraint 18 is released only after the air vehicle 12 has exited the launcher. Alternatively, the length of the pin 28 may be selected such that the restraint is released while part of the air vehicle 10 is still in the launcher, with the timing selected such that the fins 14 do not contact the side walls of the launcher.

Figure 4:
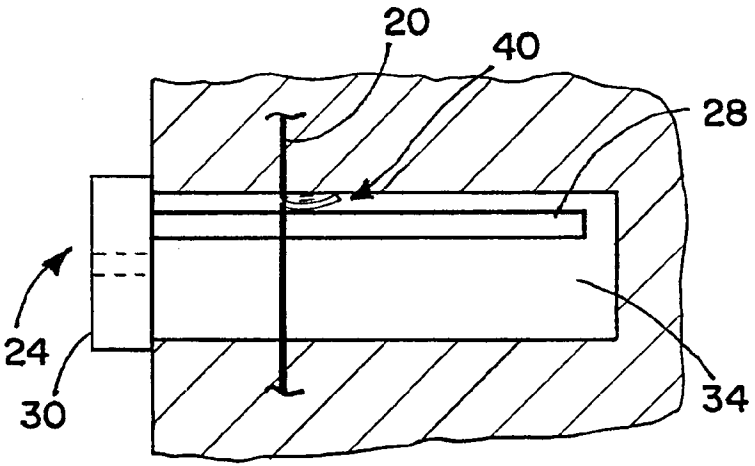
FIG. 4 is a detailed cross-sectional view of part of an alternate embodiment air vehicle in accordance with the present invention.

With reference to FIG. 4, the restraint 18 may have a spring-loaded mechanism 40 that is biased toward release of restraint 18, leading to deployment of the fins 14. To keep the fins 14 from deploying prematurely the pin 28 is kept in contact with (is mechanically coupled to) the mechanism, to prevent release of the restraint 18. Withdrawal of the pin 28 from contact with spring-loaded mechanism 40 allows the spring force to move the mechanism to release the restraint 18.

Figure 6:
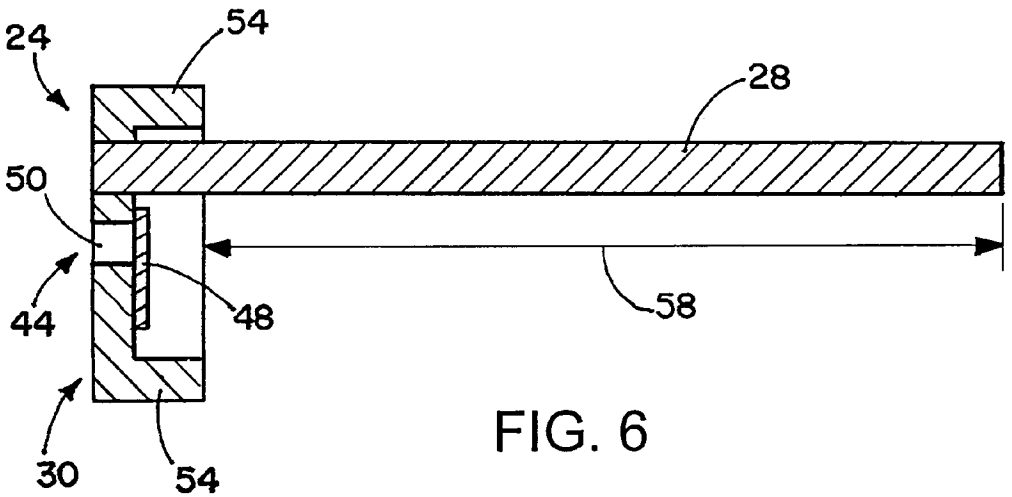
FIG. 6 is a cross-sectional view of the release mechanism of FIG. 5.
Figure 5:
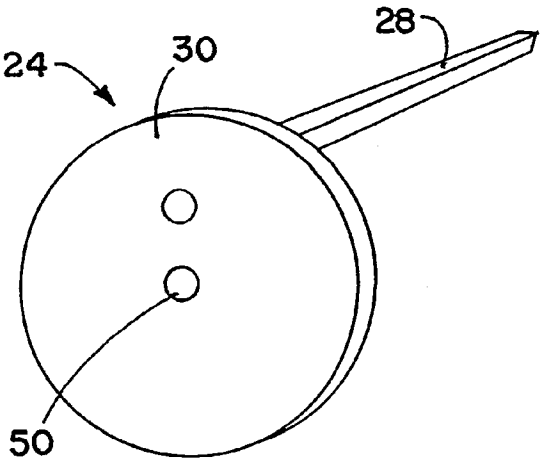
FIG. 5 is an oblique view of a release mechanism of the air vehicle of FIG. 1.

FIGS. 5 and 6 show further details of the release mechanism 24. The release mechanism 24 has a valve 44 in the base 30. The valve 44 is used to allow high-pressure gas to flow into the cavity 34 (FIG. 3) from outside of the air vehicle 10, but to prevent flow of gas in the opposite direction through the base 30. The valve 44 in the illustrated embodiment is a butterfly valve that consists of a flap 48 that is on the inside of the base 30, and that covers a hole 50 that is in the base 30. When the pressure aft of the air vehicle 10 (FIG. 1) exceeds that that is inside the cavity 34, the valve 44 opens to allow flow of high-pressure gasses into the cavity 34 through the hole 30. However, when the pressure within the cavity exceeds that aft of the air vehicle, such as when the aft part of the air vehicle 10 enters the low-pressure region, the valve 44 stays closed with the butterfly valve (flap) 48 remaining closed, retaining the high-pressure gasses within the cavity 34, for use in expelling the release mechanism 24 from the cavity 34.

The base 30 has a cup shape, with a ridge 54 around a perimeter of the base 30. The cup shape facilitates expulsion of the release mechanism 24 from the cavity 34 by capturing and better utilizing the high-pressure gasses pressing against the middle part of the base 30. The base 30 may cover substantially all of an aft-facing opening of the cavity 34 (FIG. 4)

As discussed earlier, the pin 28 has a length 58 that is selected to control the timing of the release of the restraint 18 (FIG. 1), to allow deployment of the fins 14 (FIG. 2) without having the fins 14 contact the launcher. For example the length 58 may be chosen such that the restraint 18 is released only after the air vehicle 10 clears the launcher. The length may be selected such that the aft part of the air vehicle 10 clears the muzzle brake (or other openings in the launcher) before deployment of the fins 14. For a muzzle brake length of about 1 meter, and a projectile exit speed of 500-1000 m/s, this works out to a time delay of 1-2 milliseconds. A pin length of 5 to 10 cm may be used to accomplish this delay, depending on the pressure that was captured in the cavity 34.

Many variations are possible for the embodiments described above. The valve 44 may have a variety of alternate configurations as part of the release mechanism 24 that is expelled from the cavity 34 (FIG. 2). For example the valve 44 may be a butterfly valve or other suitable check valve configuration. As another alternative, the valve may control gas flow through an opening or openings in the fuselage 12 (FIG. 1). Also, the release mechanism 24 and its parts may have any of a wide variety of other shapes, sizes, and configurations.

Figure 7:
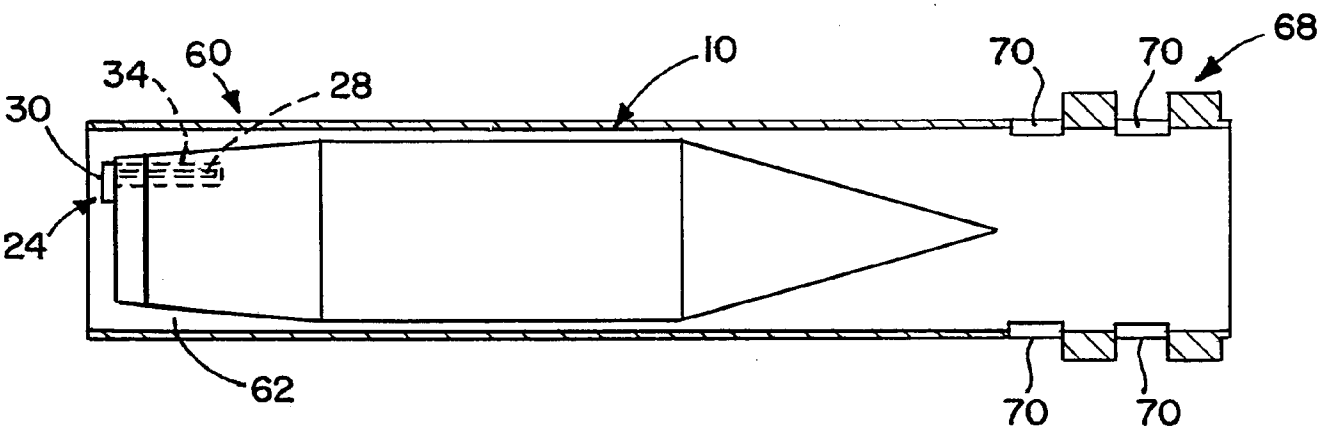
FIG. 7 is a side schematic view of a first step in accordance with a method of the present invention.

FIGS. 7-10 shows steps in the process of launch of the air vehicle 10. FIG. 7 shows the air vehicle 10 in a launcher 60, in the initial phase of the launch process. The launcher 60 may be a suitable tube or other vessel for firing or launching the air vehicle 10. Pressurized gasses produce a high-pressure region 62 behind the aft end of the air vehicle 10. An obturator or other seal (not shown) may be used to keep the pressurized gasses aft of the air vehicle 10. The pressurized gasses may be generated by a suitable material, such as a suitable fuel, explosive, or propellant. The source for the pressurized gasses may be from the air vehicle itself, or may be from a separate gas source in the launcher 60. The pressurized gasses in the high-pressure region are the driving force for moving the air vehicle 10 and expelling the air vehicle 10 from the launcher 60 toward its intended destination. For example, the air vehicle 10 may be a projectile aimed at a target. The high pressure aft of the air vehicle 10 is also transmitted into the cavity 34 in the air vehicle's fuselage 12, through the valve 44 of the release mechanism 24.

Figure 8:
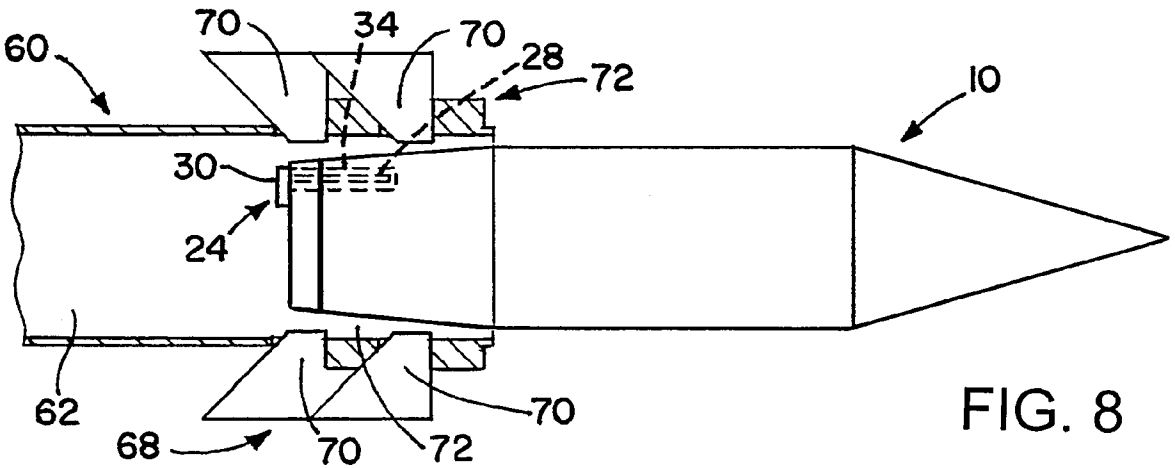
FIG. 8 is a side schematic view of a second step of the method.

FIG. 8 shows the air vehicle 10 as its aft end first reaches a muzzle brake 68 or other openings near the mouth of the launcher 60. The openings 70 of the muzzle brake 68 allow the escape of some of the pressurized gasses driving the air vehicle 10. This reduction of pressure in a (relatively) low-pressure region 72 behind the air vehicle 10 results in a pressure force imbalance on the release mechanism 24. The pressure in the cavity 34 exceeds that of the low-pressure region 62. The net pressure force on the base 30 of the release mechanism 24 pushes the release mechanism 24 aft relative to the rest of the air vehicle 10. However because of the length of the pin 28, this movement does not result in immediate release restraint 18 holding the fins 14 (FIG. 2) in the stowed position.

Figure 9:
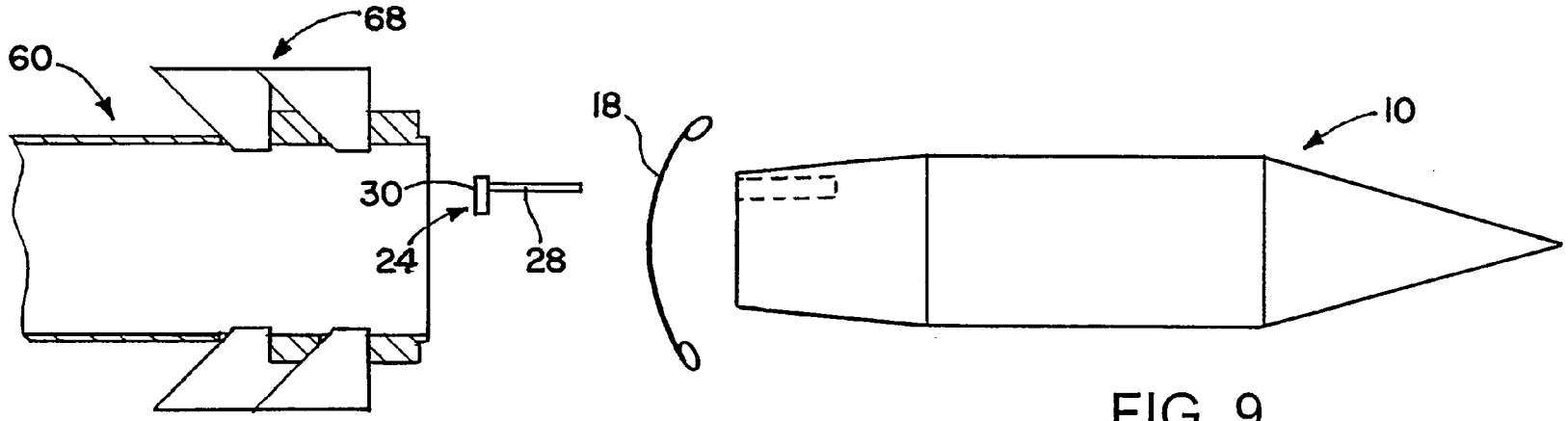
FIG. 9 is a side schematic view of a third step of the method.

FIG. 9 shows the air vehicle 10 just exiting the launcher 60. The release mechanism 24 has just exited from the cavity 34, disengaging from the restraint 18, and allowing the fins 14 to begin deployment.

Figure 10:
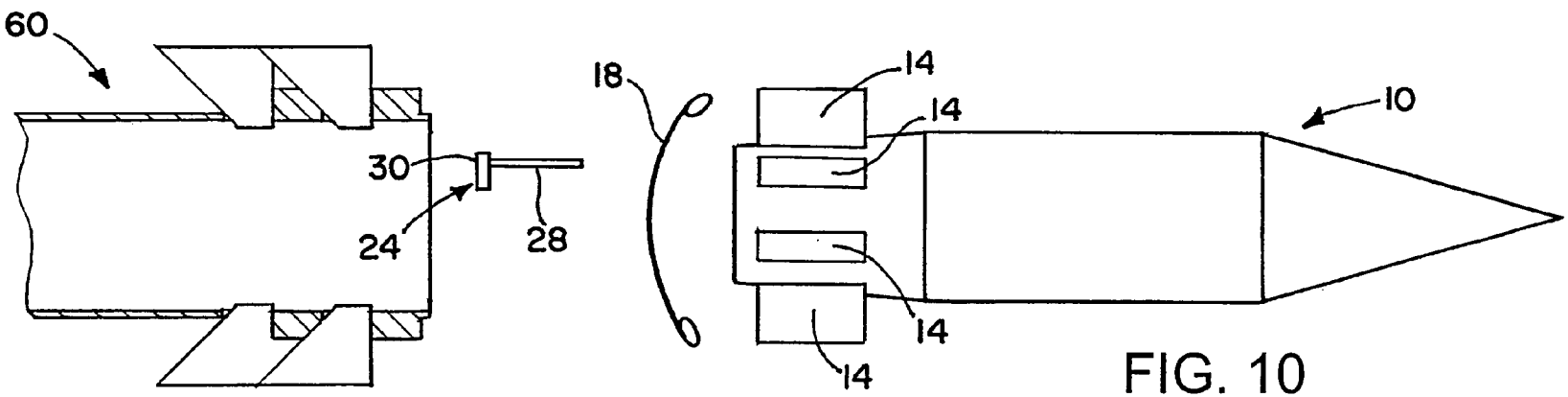
FIG. 10 is a side schematic view of a fourth step of the method.

FIG. 10 shows the air vehicle slightly later during flight, with the fins 14 fully deployed. Many variations are possible for the deployment force for the fins 14. A spring force may be used to provide the motive force for deploying the fins 14. The fins 14 may trap high-pressure gasses between them and the fuselage 12, which may provide a pressure force to at least facilitate deployment of the fins 14. As another alternative the launcher 60 may be rifled, so as to spin the air vehicle 10 about its longitudinal axis during launch. The resulting centrifugal force may push the fins 14 outward, driving or aiding in deployment of the fins 14. The fins 14 may have suitable locks to maintain them in the deployed condition once they are deployed.

The release mechanism 24 has many advantages over other ways of controlling timing for the release of the fins 14 (or other devices). The mechanism is a simple, inexpensive, reliable, and repeatable way to control timing.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An air vehicle launched from a launcher, the air vehicle comprising:

a fuselage;

fins coupled to the fuselage, wherein the fins deploy from an initial stowed configuration in the launcher to a deployed configuration in flight;

a release mechanism that releases the fins from the stowed configuration, wherein the release mechanism includes a longitudinally oriented pin in a cavity in the fuselage; and a valve that selectively lets pressurized gasses into the cavity through the valve;

wherein the pin engages a restraint that engages the fins to maintain the fins in the stowed configuration; and wherein the restraint includes a band that encircles the fuselage.

2. The air vehicle of claim 1, wherein the pin passes through loops at ends of the band to secure the restraint.

3. The air vehicle of claim 1, wherein the band is a cable.

4. An air vehicle launched from a launcher, the air vehicle comprising:

a fuselage;

fins coupled to the fuselage, wherein the fins deploy from an initial stowed configuration in the launcher to a deployed configuration in flight;

a release mechanism that releases the fins from the stowed configuration, wherein the release mechanism includes a longitudinally oriented pin in a cavity in the fuselage;

a valve that selectively lets pressurized gasses into the cavity through the valve;

wherein the pin engages a restraint that engages the fins to maintain the fins in the stowed configuration;

wherein the pin delays release of the restraint until a predetermined delay time after movement of the release mechanism; and wherein the pin has a length corresponding to the predetermined delay time.

5. The air vehicle of claim 4, wherein withdrawal of the pin from the cavity releases the fins.

6. The air vehicle of claim 1, wherein the cavity is an opening in an aft end of the air vehicle.

7. The air vehicle of claim 1, wherein the pin has a length corresponding to a delay between movement of the release mechanism and release of the fins.

8. The air vehicle of claim 1, wherein the release mechanism includes a base, and wherein the pin extends from the base into the cavity.

9. The air vehicle of claim 8, wherein the valve controls flow through a hole in the base.

10. The air vehicle of claim 9, wherein the valve is a flap on the inside of the base.

11. The air vehicle of claim 8, wherein the base has a cup shape, with a raised ridge at a perimeter of the base.

12. The air vehicle of claim 1, wherein the air vehicle is a projectile.

13. The air vehicle of claim 1, wherein the pin is configured to delay release of the restraint until a predetermined delay time of at least 1 millisecond after movement of the release mechanism.

14. The air vehicle of claim 1, wherein the pin moves at least 5 cm before releasing the restraint.

15. A method of launching an air vehicle from a launcher, the method comprising:

using pressurized gasses to move the air vehicle within the launcher;

when an aft end of the air vehicle reaches openings near the muzzle of the launcher, beginning movement of a release mechanism for releasing the fins of the air vehicle; and after a predetermined delay following the beginning movement of the release mechanism, using movement of the release mechanism to release a restraint that keeps fins of the air vehicle from deploying;

wherein moving of the release mechanism is caused by a pressure difference across a base of the release mechanism.

16. The method of claim 15, wherein releasing the restraint occurs after the aft end of the air vehicle leaves the launcher.

17. The method of claim 15, wherein releasing the restraint occurs as the release mechanism is expelled from a cavity in a fuselage of the air vehicle.

18. The method of claim 15, wherein the openings near the muzzle are part of a muzzle brake of the launcher.

19. The method of claim 15, wherein the restraint is a physical restraint that is part of the air vehicle; and wherein the movement of the release mechanism physically separates at least part of the physical restraint from the projectile.

* * * * *